US011326412B2

(12) United States Patent
Arrell, Jr.

(10) Patent No.: US 11,326,412 B2
(45) Date of Patent: May 10, 2022

(54) DOWNHOLE SEALING APPARATUSES AND RELATED DOWNHOLE ASSEMBLIES AND METHODS

(71) Applicant: Northrop Grumman Systems Corporation, Falls Church, VA (US)

(72) Inventor: John A. Arrell, Jr., Lincoln University, PA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 364 days.

(21) Appl. No.: 16/355,477

(22) Filed: Mar. 15, 2019

(65) Prior Publication Data

US 2020/0291737 A1 Sep. 17, 2020

(51) Int. Cl.

| | |
|---|---|
| ***E21B 33/124*** | (2006.01) |
| ***E21B 23/04*** | (2006.01) |
| ***E21B 23/06*** | (2006.01) |
| ***F42B 3/04*** | (2006.01) |

(52) U.S. Cl.

CPC ..... *E21B 23/0417* (2020.05); *E21B 23/0414* (2020.05); *E21B 23/065* (2013.01); *E21B 33/124* (2013.01); *F42B 3/04* (2013.01)

(58) Field of Classification Search

CPC .. E21B 33/124; E21B 23/065; E21B 23/0414; E21B 23/0417; E21B 23/04; F42B 3/04

See application file for complete search history.

(56) References Cited

U.S. PATENT DOCUMENTS

| | | | |
|---|---|---|---|
| 2,921,519 | A | 1/1960 | Martin |
| 3,023,983 | A | 3/1962 | Boorer |
| 3,029,873 | A | 4/1962 | Hanes |
| 3,090,436 | A | 5/1963 | Briggs, Jr. |
| 3,138,207 | A | 6/1964 | Peppers |
| 3,233,674 | A | 2/1966 | Leutwyler |
| 3,266,575 | A | 8/1966 | Owen |
| 3,422,760 | A | 1/1969 | Mohaupt |
| 3,602,304 | A | 8/1971 | Mallinger et al. |

(Continued)

FOREIGN PATENT DOCUMENTS

WO 2016/161379 A1 10/2016

OTHER PUBLICATIONS

Written Opinion of the International Searching Authority, ISA/KR, International Application No. PCT/US2014/017064, dated Jun. 23, 2014, 12 pages.

(Continued)

*Primary Examiner* — George S Gray
(74) *Attorney, Agent, or Firm* — TraskBritt

(57) ABSTRACT

A downhole sealing apparatus comprises a propellant section and a sealing element section adjacent the propellant section. The propellant section comprises an outer housing, at least one propellant structure within the outer housing, and at least one initiator device adjacent the at least one propellant structure. The sealing element section is configured to isolate a region of a borehole in a subterranean formation responsive to pressure of gases produced through combustion of at least one propellant of the at least one propellant structure of the propellant section. A downhole assembly and a method of isolating portions of a borehole in a subterranean formation are also disclosed.

20 Claims, 9 Drawing Sheets

(56) References Cited

U.S. PATENT DOCUMENTS

| | | | | |
|---|---|---|---|---|
| 3,677,010 | A | 7/1972 | Fink et al. | |
| 4,253,523 | A | 3/1981 | Ibsen | |
| 4,391,337 | A * | 7/1983 | Ford | E21B 43/263 102/286 |
| 4,633,951 | A | 1/1987 | Hill et al. | |
| 4,729,317 | A | 3/1988 | Burdette et al. | |
| 4,798,244 | A | 1/1989 | Trost | |
| 4,823,875 | A | 4/1989 | Hill | |
| 4,840,231 | A * | 6/1989 | Berzin | E21B 23/065 166/181 |
| 5,024,270 | A * | 6/1991 | Bostick | E21B 23/065 160/120 |
| 5,230,287 | A | 7/1993 | Arrell et al. | |
| 5,396,951 | A * | 3/1995 | Ross | E21B 23/065 166/63 |
| 5,431,101 | A | 7/1995 | Arrell et al. | |
| 5,626,360 | A | 5/1997 | Lauritzen et al. | |
| 6,055,213 | A | 4/2000 | Rubbo et al. | |
| 6,082,450 | A | 7/2000 | Snider et al. | |
| 6,263,283 | B1 | 7/2001 | Snider et al. | |
| 6,817,298 | B1 | 11/2004 | Zharkov et al. | |
| 7,073,589 | B2 | 7/2006 | Tiernan et al. | |
| 7,097,203 | B2 | 8/2006 | Burns et al. | |
| 7,353,866 | B2 | 4/2008 | Snider et al. | |
| 7,431,075 | B2 | 10/2008 | Brooks et al. | |
| 7,487,827 | B2 | 2/2009 | Tiernan | |
| 7,565,930 | B2 | 7/2009 | Seekford | |
| 7,789,153 | B2 | 9/2010 | Prinz et al. | |
| 7,810,569 | B2 | 10/2010 | Hill et al. | |
| 7,861,785 | B2 | 1/2011 | Frazier et al. | |
| 7,909,096 | B2 * | 3/2011 | Clark | E21B 33/124 166/250.17 |
| 7,950,457 | B2 | 5/2011 | Seekford | |
| 8,033,333 | B2 | 10/2011 | Frazier et al. | |
| 8,186,425 | B2 | 5/2012 | Smart et al. | |
| 8,186,435 | B2 | 5/2012 | Seekford | |
| 9,995,124 | B2 | 6/2018 | Moore et al. | |
| 10,132,148 | B2 * | 11/2018 | Moore | C06B 45/00 |
| 2003/0155112 | A1 | 8/2003 | Tiernan et al. | |
| 2005/0109509 | A1 | 5/2005 | Snider et al. | |
| 2006/0048664 | A1 | 3/2006 | Tiernan et al. | |
| 2008/0099204 | A1 | 5/2008 | Arrell et al. | |
| 2008/0314591 | A1 | 12/2008 | Hales et al. | |
| 2009/0078427 | A1 | 3/2009 | Patel | |
| 2009/0159285 | A1 | 6/2009 | Goodman | |
| 2009/0301721 | A1 | 12/2009 | Barykin | |
| 2012/0138302 | A1 | 6/2012 | Stehle | |
| 2012/0150515 | A1 | 6/2012 | Hariharan et al. | |
| 2014/0238678 | A1 | 8/2014 | Arrell et al. | |
| 2015/0267501 | A1 | 9/2015 | Al-Gouhi | |
| 2015/0275643 | A1 | 10/2015 | Holder et al. | |
| 2016/0084055 | A1 * | 3/2016 | Moore | E21B 33/124 166/299 |
| 2016/0084059 | A1 * | 3/2016 | Moore | E21B 43/247 166/299 |
| 2018/0051535 | A1 * | 2/2018 | Wang | E21B 47/12 |

OTHER PUBLICATIONS

Thakre et al. , "Solid Propellants," Rocket Propulsion, vol. 2, Encyclopedia of Aerospace Engineering, John Wiley & Sons, LTD., (2010), pp. 1-10.

Schatz, John, "PulsFrac (Trademark) Summary Technical Description," John F. Schatz Research & Consulting, Inc., Del Mar, CA, (2003), pp. 1-8.

International Search Report, ISA/KR, International Application No. PCT/US2014/017064, dated Jun. 23, 2014, three (3) pages.

European Partial Search Report for European Application No. 20162981.3, dated Jul. 13, 2020, 14 pages.

European Communication pursuant to Article 94(3) EPC for European Application No. 20162981.3, dated Jun. 30, 2021, 6 pages.

* cited by examiner

DOWNHOLE SEALING APPARATUSES AND RELATED DOWNHOLE ASSEMBLIES AND METHODS

TECHNICAL FIELD

Embodiments of the disclosure relate generally to the use of propellants for downhole applications. More particularly, embodiments of the disclosure relate to propellant-based downhole sealing apparatuses for downhole applications, and to related downhole assemblies and methods.

BACKGROUND

Numerous downhole operations (e.g., logging operations, measurement operations, coring operations, conditioning operations, monitoring operations, completion operations) rely on expandable sealing apparatuses to isolate one or more regions of a borehole (e.g., a wellbore) extending into a subterranean formation. Such sealing apparatuses are commonly referred to as "packers" if placed between the ends of a downhole string of tubulars, such as tubing strings. If placed at the lower end of a tubular string, such sealing devices are commonly referred to as a "plug" or a "bridge plug." The sealing device is run into the borehole in an unexpanded state and then "set" (e.g., activated to expand) within a borehole to seal off the borehole. Unfortunately, conventional downhole systems, conventional downhole assemblies, and conventional downhole processes employing conventional sealing apparatuses (e.g., conventional packers, conventional bridge plug) can require complex, time-consuming, and/or cost-prohibitive methods and equipment to set the conventional packers sealing apparatuses before of performing desired downhole operations using one or more associated downhole devices (e.g., downhole tools, such as logging tools, measurement tools, coring tools, conditioning tools, monitoring tools, completion tools, etc.), and can also undesirably require either permanently leaving the conventional sealing apparatuses in place within the borehole following the desired downhole operations, or implementing additional complex, time-consuming, and/or cost-prohibitive methods and equipment to remove the conventional packers from the borehole following the desired downhole operations.

It would, therefore, be desirable to have new downhole sealing apparatuses, new downhole assemblies, and new methods of acting upon a subterranean formation that alleviate one or more of the foregoing problems.

BRIEF SUMMARY

In some embodiments, a downhole sealing apparatus comprises a propellant section and a sealing element section adjacent the propellant section. The propellant section comprises an outer housing, at least one propellant structure within the outer housing, and at least one initiator device adjacent the at least one propellant structure. The sealing element section is configured to isolate a region of a borehole in a subterranean formation responsive to pressure of gases produced through combustion of at least one propellant of the at least one propellant structure of the propellant section.

In additional embodiments, a downhole assembly comprises at least one downhole device, and at least one downhole sealing apparatus attached to the at least one downhole device. The at least one downhole sealing apparatus comprises a propellant section, and a sealing element section adjacent the propellant section. The propellant section comprises an outer housing, a propellant structure within the outer housing, and an initiator device within the outer housing and adjacent the propellant structure. The sealing element section is configured to isolate a region of a borehole in a subterranean formation responsive to pressure of gases produced through combustion of at least one propellant of the propellant structure of the propellant section.

In further embodiments, a method of isolating portions of a borehole in a subterranean formation comprises positioning a downhole assembly within a borehole extending into the subterranean formation. The downhole assembly comprises a downhole device, and a downhole sealing apparatus attached to the downhole device and comprising a propellant section and a sealing element section adjacent the propellant section. The propellant section comprises an outer housing, a propellant structure within the outer housing, and an initiator device within adjacent the propellant structure. The initiator device of the propellant section of the downhole sealing apparatus is activated to initiate and combust at least one propellant of the propellant structure and produce gases that are directed to activate the sealing element section of the downhole sealing apparatus and seal across the borehole.

DETAILED DESCRIPTION

Figure 1:
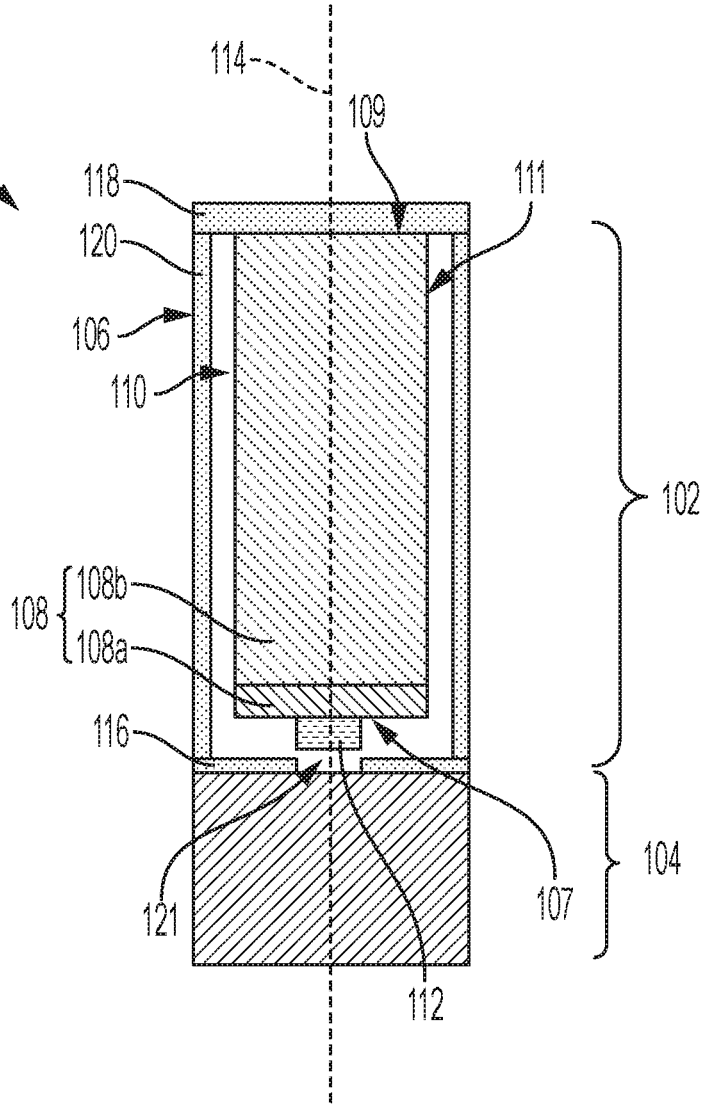
FIG. 1 is a simplified longitudinal, cross-sectional view of a downhole sealing apparatus, in accordance with embodiments of the disclosure.

Downhole sealing apparatuses are disclosed, as are related downhole assemblies and methods. In some embodiments, a downhole sealing apparatus includes a propellant section and a sealing element section adjacent the propellant section. The propellant section comprises an outer housing, at least one propellant structure within (e.g., substantially confined within) the outer housing, and at least one initiator device adjacent the propellant structure. The sealing element section is configured to isolate (e.g., seal off) a region of a borehole (e.g., a wellbore) in a subterranean formation (e.g., a producing formation, such as a hydrocarbon producing formation) using gases produced through combustion of the propellant structure of the propellant section. The downhole sealing apparatuses, downhole assemblies, and methods of the disclosure may provide simple, cost-effective, and enhanced treatment of a subterranean formation as compared to conventional downhole sealing apparatuses, conventional downhole assemblies, and conventional methods.

In the following detailed description, reference is made to the accompanying drawings that depict, by way of illustration, specific embodiments in which the disclosure may be practiced. However, other embodiments may be utilized, and structural, logical, and configurational changes may be made without departing from the scope of the disclosure. The illustrations presented herein are not meant to be actual views of any particular material, component, apparatus, assembly, system, or method, but are merely idealized representations that are employed to describe embodiments of the present disclosure. The drawings presented herein are not necessarily drawn to scale. Additionally, elements common between drawings may retain the same numerical designation.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the term "configured" refers to a size, shape, material composition, material distribution, orientation, and arrangement of one or more of at least one structure, at least one apparatus, at least one assembly, and at least one system facilitating operation of the one or more of the at least one structure, the at least one apparatus, the at least one assembly, and the at least one system in a predetermined way.

As used herein, the singular forms "a," "an," and "the" are intended to include the plural forms as well, unless the context clearly indicates otherwise.

As used herein, "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, at least 99.9% met, or even 100.0% met.

As used herein, "about" or "approximately" in reference to a numerical value for a particular parameter is inclusive of the numerical value and a degree of variance from the numerical value that one of ordinary skill in the art would understand is within acceptable tolerances for the particular parameter. For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

FIG. 1 is a longitudinal, cross-sectional view of a downhole sealing apparatus 100, in accordance with an embodiment of the disclosure. The downhole sealing apparatus 100 may be configured and operated to temporarily seal (e.g., temporarily close off, temporarily isolation) a portion of a borehole (e.g., a wellbore) extending into a subterranean formation (e.g., a producing formation, such as a hydrocarbon producing formation). The downhole sealing apparatus 100 may, for example, be a component (e.g., module) of a downhole assembly (e.g., a downhole assembly including one or more downhole devices attached to the downhole sealing apparatus 100) for acting upon (e.g., treating, analyzing, monitoring) the subterranean formation, as described in further detail below. The components (e.g., the downhole sealing apparatus 100, the downhole device(s)) of the downhole assembly may be of modular design. The downhole sealing apparatus 100 may include a propellant section 102, and a sealing element section 104 (e.g., sealing element section, plug section, bridge plug section) connected to the propellant section 102.

As shown in FIG. 1, the propellant section 102 of the downhole sealing apparatus 100 includes an outer housing 106, at least one propellant structure 108, and at least one initiator device 112. The propellant structure 108 and the initiator device 112 may be substantially contained (e.g., substantially confined, substantially held) within the outer housing 106.

The outer housing 106 of the propellant section 102 may comprise any structure configured to contain (e.g., house, hold, etc.) the propellant structure 108 and the initiator device 112, and also configured to temporarily hold and direct gases produced during combustion of the propellant structure 108 to the sealing element section 104 of the downhole sealing apparatus 100. For example, as shown in FIG. 1, the outer housing 106 may comprise a substantially hollow and elongate structure (e.g., a hollow tube) having a first end 116, a second, opposing end 118, and at least one sidewall 120 extending from and between the first end 116 and the second, opposing end 118. The first end 116 may be configured for attachment to the sealing element section 104 of the downhole sealing apparatus 100, and the second, opposing end 118 may be configured for attachment to a downhole device. The sidewall 120 of the outer housing 106 may be oriented parallel to a longitudinal axis 114 of the downhole sealing apparatus 100.

The outer housing 106 may comprise a single, substantially monolithic structure, or may comprise a plurality of (e.g., multiple) connected (e.g., attached, coupled, bonded, etc.) structures. As used herein, the term "monolithic structure" means and includes a structure formed as, and comprising a single, unitary structure of a material. As shown in FIG. 1, at least the first end 116 may include one or more apertures 121 (e.g., openings, holes, through vias) therein configured and positioned to direct gases produced during combustion of the propellant structure 108 to (e.g., into) the sealing element section 104 of the downhole sealing apparatus 100. In some embodiments, the first end 116 of the outer housing 106 includes an aperture 121 exhibiting a relatively smaller diameter than a longitudinally central portion of the outer housing 106. The first end 116 may, for example, comprise a nozzle connected to the sidewall 120 of the outer housing 106. In additional embodiments, the first end 116 of the outer housing 106 includes multiple apertures 121 each individually exhibiting a relatively smaller diameter than a longitudinally central portion of the outer housing 106. The sidewall 120 of the outer housing 106 may be substantially free of apertures extending therethrough. Accordingly, at least a majority (e.g., substantially all) of the gases produced during combustion of the propellant structure 108 may be directed to the sealing element section 104 of the downhole sealing apparatus 100.

The propellant structure 108 of the propellant section 102 may comprise a non-composite structure formed of and including a single (e.g., only one) propellant, or may comprise composite structure formed of and including at least two regions exhibiting mutually different propellants. For example, as shown in FIG. 1, the propellant structure 108 may each be formed of and include at least one faster combustion rate region 108*a* and at least one slower combustion rate region 108*b*. The regions 108*a*, 108*b* may also be characterized, as is commonly done by those of ordinary skill in the art, as propellant "grains." The faster combustion rate region 108*a* may, for example, be formed of and include at least one propellant exhibiting a combustion rate within a range of from about 0.1 inch per second (in/sec) to about 4.0 in/sec at 1,000 pounds per square inch (psi) at an ambient temperature of about 70° F. In turn, the slower combustion rate region 108*b* may be formed of and include at least one different propellant exhibiting a slower combustion rate than the faster combustion rate region 108*a* within the range of from about 0.1 in/sec to about 4.0 in/sec at 1,000 psi at an ambient temperature of about 70° F. In additional embodiments, the propellant structure 108 includes only one propellant (e.g., only one propellant grain) exhibiting a combustion rate within a range of from about 0.1 in/sec to about 4.0 in/sec at 1,000 psi at an ambient temperature of about 70° F. Combustion rates of propellants may vary, as known to those of ordinary skill in the art, with exposure to pressure and temperature conditions at variance from the above pressure and temperature conditions, such as those experienced by a propellant before and during combustion.

The propellant structure 108 may be formed of and include any desired quantity and arrangement of one or more propellants facilitating activation and maintenance of the sealing element section 104 of the downhole sealing apparatus 100 in a pre-determined way, as described in further detail below. As shown in FIG. 1, in some embodiments, the propellant structure 108 includes a faster combustion rate region 108*a* more proximate the first end 116 of the outer housing 106, and a slower combustion rate region 108*b* more distal from the first end 116 of the outer housing 106. In further embodiments, the slower combustion rate region 108*b* is located more proximate the first end 116 of the outer housing 106, and the faster combustion rate region 108*a* is located more distal from the first end 116 of the outer housing 106. In addition, while various embodiments herein describe or illustrate the propellant structure 108 as each being formed of and including a single (e.g., only one) faster combustion rate region 108*a* and a single (e.g., only one) slower combustion rate region 108*b*, the propellant structure 108 may, alternatively, be formed of and include one or more a different quantity of faster combustion rate regions 108*a* and/or a different quantity of slower combustion rate regions 108*b*. For example, the propellant structure 108 may include multiple (e.g., more than one) faster combustion rate regions 108*a* and/or multiple (e.g., more than one) slower combustion rate regions 108*b*. If the propellant structure 108 includes multiple faster combustion rate regions 108*a*, each of the multiple faster combustion rate regions 108*a* may exhibit substantially the same material composition, material distribution, dimensions, and shape as each other of the multiple faster combustion rate regions 108*a*, or at least one of the multiple faster combustion rate regions 108*a* may one or more of a different material composition, a different material distribution, different dimensions, and a different shape than at least one other of the multiple faster combustion rate regions 108*a*. In addition, if the propellant structure 108 includes multiple slower combustion rate regions 108*b*, each of the multiple slower combustion rate regions 108*b* may exhibit substantially the same material composition, material distribution, dimensions, and shape as each other of the multiple slower combustion rate regions 108*b*, or at least one of the multiple slower combustion rate regions 108*b* may one or more of a different material composition, a different material distribution, different dimensions, and a different shape than at least one other of the multiple slower combustion rate regions 108*b*. As another example, the propellant structure 108 may include the faster combustion rate region 108*a* but not the slower combustion rate region 108*b*, or may include the slower combustion rate region 108*b* but not the faster combustion rate region 108*a*.

The propellant structure 108, including the different regions thereof (e.g., the faster combustion rate region 108*a*, the slower combustion rate region 108*b*), may exhibit any desired structural configuration(s) of the propellant(s) thereof. In some embodiments, the propellant structure 108 comprises one or more bulk structures individually exhibiting a desired shape (e.g., a cylindrical shape, a hemispherical shape, a semi-cylindrical shape, a tubular shape, a conical shape, a pyramidal shape, a cubic shape, cuboidal shape, a spherical shape, truncated versions thereof, or an irregular three-dimensional shape) and a desired size. As a non-limiting example, the propellant structure 108 may include a first bulk structure forming the faster combustion rate region 108*a* thereof, and a second bulk structure forming the slower combustion rate region 108*b* thereof. The first bulk structure and the second bulk structure may, for example, each individually exhibit a cylindrical shape having a diameter extending across at least a majority (e.g., greater than 50 percent, such as greater than or equal to about 75 percent, or greater than or equal to about 90 percent) of lateral (e.g., horizontal) dimensions (e.g., a width) an internal chamber of the outer housing 106 holding the propellant structure 108. In additional embodiments, one or more (e.g., all, less than all) of the regions of the propellant structure 108 (e.g., the faster combustion rate region 108*a*, the slower combustion rate region 108*b*) are individually formed of and include a plurality of discrete (e.g., separate, unconnected) structures (e.g., pellets). As a non-limiting example, the faster combustion rate region 108*a* may include a first plurality of discrete structures contained (e.g., packed) within the volume of the faster combustion rate region 108*a*; and the slower combustion rate region 108*b* include a second plurality of discrete structures contained (e.g., packed) within the volume of the slower combustion rate region 108*b*. In included, each of the plurality of discrete structures may individually exhibit a desired shape (e.g., a spherical shape, a cylindrical shape, a hemispherical shape, a semi-cylindrical shape, a tubular shape, an annular shape, a conical shape, a pyramidal shape, a cubic shape, cuboidal shape, truncated versions thereof, or an irregular three-dimensional shape) and a desired size. The plurality of discrete structures may, for example, comprise one or more of discrete spheres, discrete chips, discrete rings, and discrete cylinders (e.g., discrete rods) of propellant(s). If included, the plurality of discrete structures may be contained within at least one relatively larger structure (e.g., a relatively larger tubular structure) to form one or more of the regions of the propellant structure 108. The relatively larger structure may, for example, be formed of and include one or more of a metallic material (e.g., a metal, an alloy), polymeric material (e.g., a plastic, a rubber), an organic material (e.g., paper, wood), and a ceramic material. In some embodiments, the relatively larger structure is an insulated liner structure (e.g., a tubular insulated liner structure).

Propellant(s) of the propellant structure 108 (e.g., propellant of the faster combustion rate region 108*a*, and propellant of the slower combustion rate region 108*b*) suitable for implementation of embodiments of the disclosure may include, without limitation, materials used as solid rocket motor propellants. Various examples of such propellants and components thereof are described in Thakre et al., *Solid Propellants*, Rocket Propulsion, Volume 2, Encyclopedia of Aerospace Engineering, John Wiley & Sons, Ltd. 2010, the disclosure of which document is hereby incorporated herein in its entirety by this reference. The propellant(s) may be class 4.1, 1.4, or 1.3 materials, as defined by the United States Department of Transportation (US DOT) shipping classification, so that transportation restrictions are minimized. Transportation of the propellant(s) may also comply with United Nations (UN) Recommendations on the Transportation of Dangerous Goods.

By way of non-limiting example, the propellant(s) of the propellant structure 108 may individually be formed of and include a polymer having at least one of a fuel and an oxidizer incorporated therein. The polymer may be an energetic polymer or a non-energetic polymer, such as glycidyl nitrate (GLYN), nitratomethylmethyloxetane (NMMO), glycidyl azide (GAP), diethyleneglycol triethyleneglycol nitraminodiacetic acid terpolymer (9DT-NIDA), bis(azidomethyl)-oxetane (BAMO), azidomethylmethyloxetane (AMMO), nitraminomethyl methyloxetane (NAMMO), bis(difluoroaminomethyl)oxetane (BFMO), difluoroaminomethylmethyloxetane (DFMO), copolymers thereof, cellulose acetate, cellulose acetate butyrate (CAB), nitrocellulose, polyamide (nylon), polyester, polyethylene, polypropylene, polystyrene, polycarbonate, a polyacrylate, a wax, a hydroxyl-terminated polybutadiene (HTPB), a hydroxyl-terminated poly-ether (HTPE), carboxyl-terminated polybutadiene (CTPB) and carboxyl-terminated polyether (CTPE), diaminoazoxy furazan (DAAF), 2,6-bis (picrylamino)-3,5-dinitropyridine (PYX), a polybutadiene acrylonitrile/acrylic acid copolymer binder (PBAN), polyvinyl chloride (PVC), ethylmethacrylate, acrylonitrile-butadiene-styrene (ABS), a fluoropolymer, polyvinyl alcohol (PVA), or combinations thereof. The polymer may function as a binder, within which the at least one of the fuel and oxidizer is dispersed. The fuel may be a metal, such as aluminum, nickel, magnesium, silicon, boron, beryllium, zirconium, hafnium, zinc, tungsten, molybdenum, copper, or titanium, or alloys mixtures or compounds thereof, such as aluminum hydride ($AlH_3$), magnesium hydride ($MgH_2$), or borane compounds ($BH_3$). The metal may be used in powder form. The oxidizer may be an inorganic perchlorate, such as ammonium perchlorate or potassium perchlorate, or an inorganic nitrate, such as ammonium nitrate or potassium nitrate. Other oxidizers may also be used, such as hydroxylammonium nitrate (HAN), ammonium dinitramide (ADN), hydrazinium nitroformate, a nitramine, such as cyclotetramethylene tetranitramine (HMX), cyclotrimethylene trinitramine (RDX), 2,4,6,8,10,12-hexanitro-2,4,6,8,10,12-hexaazaisowurtzitane (CL-20 or HNIW), and/or 4,10-dinitro-2,6,8,12-tetraoxa-4,10-diazatetracyclo-[5.5.0.0 $^{5,9}$.0 $^{3,11}$]-dodecane (TEX). In addition, one or more of the propellants of the propellant structure 108 may include additional components, such as at least one of a plasticizer, a bonding agent, a combustion rate modifier, a ballistic modifier, a cure catalyst, an antioxidant, and a pot life extender, depending on the desired properties of the propellant. These additional components are well known in the rocket motor art and, therefore, are not described in detail herein. The components of the propellant(s) of the propellant structure 108 may be combined by conventional techniques, which are not described in detail herein.

Each region of the propellant structure 108 may individually be substantially homogeneous. For example, if the propellant structure 108 includes the faster combustion rate region 108*a* and the slower combustion rate region 108*b*, the faster combustion rate region 108*a* may be formed of and include a single (e.g., only one) propellant, and the slower combustion rate region 108*b* may be formed of and include a single, different propellant. As another example, if the propellant structure 108 is free of regions having different combustion rates than one another, the propellant structure 108 as a whole may be formed of and include a single propellant. In additional embodiments, one or more regions of the propellant structure 108 may be heterogeneous. For example, if the propellant structure 108 includes the faster combustion rate region 108*a* and the slower combustion rate region 108*b*, one or more of the faster combustion rate region 108*a* and the slower combustion rate region 108*b* may include a volume of one propellant at least partially laterally surrounded by a volume of another, different propellant.

If the propellant structure 108 includes regions having different combustion rates than one another (e.g., the faster combustion rate region 108*a* and the slower combustion rate region 108*b*), each of the regions of the propellant structure 108 may exhibit substantially the same volume of propellant as one another, or at least one of the regions of the propellant structure 108 may exhibit a different volume of propellant than at least one other of the regions of the propellant structure 108. For example, the faster combustion rate region 108*a* and the slower combustion rate region 108*b* of the propellant structure 108 may exhibit substantially the same volume of propellant, or the faster combustion rate region 108*a* may exhibit a different volume (e.g., a smaller volume, a greater volume) of propellant than the slower combustion rate region 108*b*. In some embodiments, the faster combustion rate region 108*a* exhibits a smaller volume of propellant than the slower combustion rate region 108*b*.

The configuration of the propellant structure 108, including the configurations of different regions (e.g., the faster combustion rate region 108*a* and the slower combustion rate region 108*b*) thereof, may at least partially depend on desired activation (e.g., setting) and maintenance (e.g., sustained inflation, sustained expansion, etc.) characteristics of the sealing element section 104 of the downhole sealing apparatus 100, as described in further detail below. By way of non-limiting example, the configuration and position the faster combustion rate region 108*a* may facilitate rapid activation of the sealing element section 104 through higher pressure initially and relatively briefly supplied to the sealing element section 104 through combustion and expenditure of the faster combustion rate region 108*a*, and the configuration and position of the slower combustion rate region 108*b* may maintain the sealing element section 104 in the activated state for a desired period of time through lower pressure supplied to the sealing element section 104 through combustion and expenditure of the slower combustion rate region 108*b*. The durations different pressures (e.g., higher pressures, lower pressures) supplied to the sealing element section 104 of the downhole sealing apparatus 100 may be controlled at least partially by the combustion rates and volumes of the different regions (e.g., different combustion rate regions, such as the faster combustion rate region 108*a* and the slower combustion rate region 108*b*) of the propellant structure 108.

Various configurations of the propellant structure 108 for desirable sealing characteristics of the downhole sealing apparatus 100 may be selected and produced using mathematical modeling and/or historical data (e.g., empirical data obtained through previous propellant structure production and analysis). If employed, the mathematical modeling may be based upon ballistics codes for solid rocket motors but adapted for physics (i.e., pressure and temperature conditions) experienced downhole, as well as for the configurations of the sealing element section 104 and at least the outer housing 106 of the propellant section 102 of the downhole sealing apparatus 100. The ballistics codes may be extrapolated with a substantially time-driven combustion rate. Of course, the codes may be further refined over time by correlation to multiple iterations of empirical data obtained in physical testing under simulated downhole environments and actual downhole operations.

The propellant structure 108 may be formed using conventional processes and conventional equipment, which are not described in detail herein. By way of non-limiting example, the propellant structure 108 may be conventionally cast, conventionally extruded, and/or conventionally machined to a substantially uniform diameter and placed within outer housing 106. If it is desired for the propellant structure 108 to be a composite structure formed of and including at least two regions exhibiting different propellants than one another, different propellant grains individually conventionally cast, conventionally extruded, and/or conventionally machined to a substantially uniform diameter may be placed longitudinally adjacent one another within the outer housing 106 to form the propellant structure 108. In some embodiments, the propellant structure 108 is preassembled prior to transport to a site (e.g., a rig site) of a borehole in a subterranean formation to be treated. In additional embodiments, the propellant structure 108 is assembled at the site of the borehole in the subterranean formation from multiple pre-formed structures transported to the site, and selected and configured based on the predetermined (e.g., by way of mathematical modeling, previous experience, or combinations thereof) borehole sealing and/or subterranean formation treatment needs. The propellant structure 108 may also be produced in the field by severing selected lengths of propellant grains of particular types from longer propellant grains and then assembling the selected lengths of the propellant grains relative to one another.

Optionally, one or more of a heat insulator, a combustion inhibitor, and a liner may be interposed between the outer housing 106 and the propellant structure 108. The heat insulator may be configured and positioned to protect (e.g., shield) the outer housing 106 from damage associated with the high temperatures and high velocity particles produced during combustion of the propellant structure 108. The combustion inhibitor may be configured and positioned to thermally protect and at least partially control the ignition and combustion of the propellant structure 108, including different regions thereof (e.g., the faster combustion rate region 108*a*, the slower combustion rate region 108*b*, etc.). The liner may be configured and positioned to bond (e.g., directly bond, indirectly bond) the propellant structure 108 to at least one of the heat insulating layer and the outer housing 106. The liner may also be configured to prevent, by substantially limiting, interactions between the propellant structure 108 and wellbore fluids during use and operation of the downhole sealing apparatus 100. The liner may, for example, prevent leaching of the propellants of the propellant structure 108 into the downhole environment during use and operation of the downhole sealing apparatus 100. In some embodiments, the heat insulator is formed (e.g., coated, applied, etc.) on or over an inner surface of the outer housing 106, the combustion inhibitor is formed (e.g., coated, applied, etc.) on or over peripheral surfaces of the propellant structure 108, and the liner is formed on or over the combustion inhibitor layer. Suitable heat insulators, suitable combustion inhibitors, and suitable liners, and as well as a process of forming the heat insulating layers, the combustion inhibitors, and the liners, and are known in the art, and therefore are not described in detail herein. In some embodiments, the combustion inhibitor comprises substantially the same polymer as a polymer of at least one propellant of the propellant structure 108 (e.g., PVC if a propellant of the propellant structure 108 is formed of includes PVC, etc.), and the liner comprises at least one of an epoxy, a urethane, a cyanoacrylate, a fluoroelastomer, mica, and graphite, such as the materials described in U.S. Pat. Nos. 7,565,930, 7,950,457 and 8,186,435 to Seekford, the disclosure of each of which is incorporated herein in its entirety by this reference.

With continued reference to FIG. 1, the initiator device 112 may be configured and positioned to facilitate the ignition (e.g., initiation) and combustion of the propellant structure 108. As shown in FIG. 1, in some embodiments, the initiator device 112 is provided adjacent a first end 107 of the propellant structure 108 proximate the first end 116 of the outer housing 106 of the propellant section 102 of the downhole sealing apparatus 100. The initiator device 112 may thus facilitate the ignition and combustion of the propellant structure 108 from the first end 107 of the propellant structure 108. As depicted in FIG. 1, the initiator device 112 may be positioned adjacent the first end 107 of the propellant structure 108 along the longitudinal axis 114 of the downhole sealing apparatus 100. In additional embodiments, the initiator device 112 is positioned adjacent the first end 107 of the propellant structure 108 at a different position, such as at a position offset from (e.g., unaligned with) the longitudinal axis 114 of the downhole sealing apparatus 100. In further embodiments, multiple initiator devices 112 are disposed over the first end 107 of the propellant structure 108 to ensure fail-safe operation. In still further embodiments, one or more initiator devices 112 are provided over one or more different peripheral portions of the propellant structure 108, such as one or more of a second, opposing end 109 of the propellant structure 108 and/or a sidewall 111 of the propellant structure 108. Providing initiator devices 112 over more than one peripheral portion (e.g., over two or more of the first end 107, the second, opposing end 109, and the sidewall 111) of the propellant structure 108 may facilitate the initiation of multiple combustion fronts on the propellant structure 108. In yet further embodiments, one or more initiator devices 112 are positioned within the propellant structure 108. For example, at least one initiator devices 112 may be embedded within the propellant structure 108 at one or more locations between the first end 107 and the second, opposing end 109.

As shown in FIG. 1, in some embodiments wherein the propellant structure 108 includes a faster combustion rate region 108*a* and a slower combustion rate region 108*b*, at least one initiator device 112 is provided adjacent the faster combustion rate region 108*a*. Accordingly, activation of the initiator device 112 may initiate combustion of the propellant structure 108 at the faster combustion rate region 108*a*, which may then spread to the slower combustion rate region 108*b* after the faster combustion rate region 108*a* is substantially expended (e.g., substantially combusted). In additional embodiments, at least one initiator device 112 is provided adjacent the slower combustion rate region 108*b* of the propellant structure 108. In further embodiments, at least one initiator device 112 is provided adjacent the faster combustion rate region 108*a* of the propellant structure 108, and at least one additional initiator device 112 is provided adjacent the slower combustion rate region 108*b* of the propellant structure 108.

The at least one initiator device 112 may be a conventional initiator device, and is therefore not described in detail herein. By way of non-limiting example, the initiator device 112 may comprise a conventional semiconductive bridge (SCB) initiator device, such as those described in U.S. Pat. Nos. 5,230,287 and 5,431,101 to Arrell, Jr. et al., the disclosure of each of which is hereby incorporated herein in its entirety by this reference. If the propellant section 102 includes multiple initiator devices 112 each of the multiple initiator devices 112 may have substantially the same configuration, or at least one of the multiple initiator devices 112 may have a different configuration than at least one other of the multiple initiator devices 112. Optionally, one or more materials and/or structures (e.g., caps) may be provided on or over the initiator device 112 to prevent, by substantially limiting, interactions between the initiator device 112 and wellbore fluids during use and operation of the downhole sealing apparatus 100. Suitable materials and/or structures are well known in the art, and are therefore not described in detail herein.

One or more devices and processes may be utilized to activate (e.g., trigger) the initiator device 112. Suitable devices and processes for activating the initiator device 112 are known in the art, and are therefore not described in detail herein. However, activation of the initiator device 112 using electrical signals carried by a wire line extending to the downhole sealing apparatus 100 is specifically contemplated, as is activation using a trigger mechanism activated by increased borehole pressure, or pressure within a tubing string at the end of which the downhole sealing apparatus 100 is deployed. If the propellant section 102 of the downhole sealing apparatus 100 includes multiple initiator devices 112, the one or more devices may be employed to active each of the initiator devices 112 substantially simultaneously, or to activate at least one of the initiator devices 112 in sequence with at least one other of the initiator devices 112. An activation assembly for the initiator devices 112 may, for example, include one or more wire lines extending to a processor-controlled multiplexor carried by the downhole sealing apparatus 100, wherein the processor is programmable and pre-programmed to initiate a firing sequence for the initiator devices 112. Non-limiting examples of other suitable activation assemblies include electronic time delay assemblies and pyrotechnic time delay assemblies, such as one or more of the assemblies described in U.S. Pat. No. 7,789,153 to Prinz et al., the disclosure of which is hereby incorporated herein in its entirety by this reference.

With continued reference to FIG. 1, the sealing element section 104 of the downhole sealing apparatus 100 may be coupled to the propellant section 102 of the downhole sealing apparatus 100. As described in further detail below, the sealing element section 104 may be configured and operated to isolate at least one region of a borehole (e.g., a wellbore) in a subterranean formation (e.g., a producing formation) to be acted upon (e.g., analyzed, treated) by a downhole device connected to the downhole sealing apparatus 100 using combustion gases produced by the propellant section 102. As shown in FIG. 1, the sealing element section 104 may attached to the first end 116 of the outer housing 106 of the propellant section 102 such that gases exiting the propellant section 102 (e.g., during combustion of the propellant structure 108 thereof) by way of the aperture 121 in the first end 116 of the outer housing 106 are directed to (e.g., into) the sealing element section 104. The sealing element section 104 may be removably attached to the propellant section 102, or may be substantially permanently attached (e.g., absent permanent destructive action to one or more attachment means) to the propellant section 102. In some embodiments, the sealing element section 104 is removably attached to the propellant section 102. For example, the sealing element section 104 may be removably attached to one or more portions of the outer housing 106 by way of one or more of complementary thread structures (e.g., threading projections) and complementary pin and opening features exhibited by the sealing element section 104 and the outer housing 106 of the propellant section 102, or a shear pin structure configured to separate under sufficient applied longitudinal force. In additional embodiments, the sealing element section 104 is substantially permanently attached to the propellant section 102. For example, the sealing element section 104 may be welded, brazed, soldered, and/or substantially permanently adhesively bonded to the outer housing 106 of the propellant section 102.

Figure 2A:
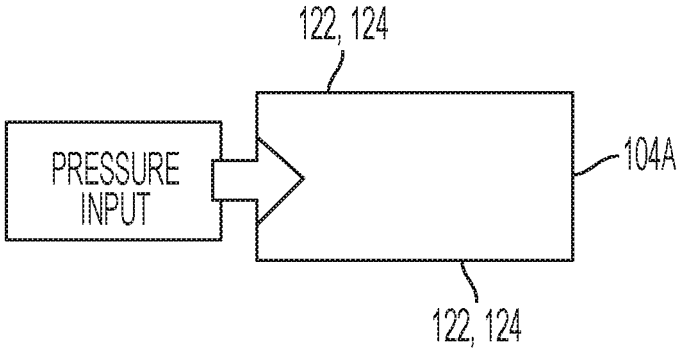
FIGS. 2A through 2C are simplified schematic views of a sealing element section of the downhole sealing apparatus shown in FIG. 1, in accordance with embodiments of the disclosure.
Figure 2B:
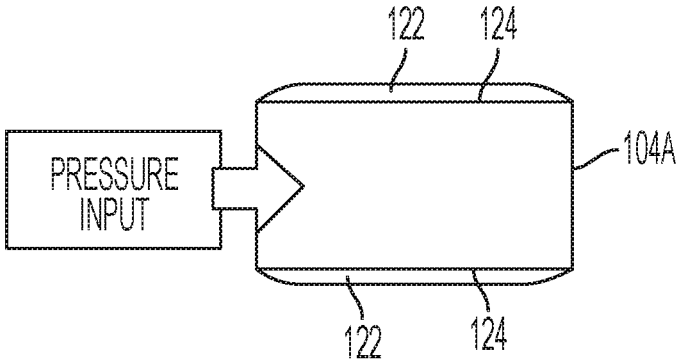

In some embodiments, the sealing element section 104 of the downhole sealing apparatus 100 has an inflatable design. For example, FIG. 2A shows a schematic illustration of an inflatable sealing element 104A that may be employed for the sealing element section 104 of the downhole sealing apparatus 100 shown in FIG. 1. As shown in FIG. 2A, the inflatable sealing element 104A may include at least one radially expandable bladder 122 secured about a mandrel 124. The radially expandable bladder 122 may be formed of a material (e.g., a metallic material, such as a metal or alloy) having sufficient elasticity to expand radially, as shown in FIG. 2B, under increased internal pressure facilitated by the production gases through the combustion of the propellant structure 108 (FIG. 1) of the propellant section 102 (FIG. 1) of the downhole sealing apparatus 100 (FIG. 1). The radially expandable bladder 122 may be configured and operated to seal without substantial plastic deformation thereof, so as to ensure retraction of the radially expandable bladder 122 to substantially an initial, pre-expansion diameter upon normalization of borehole (e.g., wellbore) pressure and permit withdrawal of the downhole sealing apparatus 100 (FIG. 1) from the borehole. Other elastic bladder materials known to those of ordinary skill in the art and suitable for maintaining structural integrity upon exposure to anticipated borehole conditions (e.g., temperatures, pressures, material types and exposures, etc.) may also be employed, such materials having sufficient elasticity to collapse from an expanded state responsive to normalization of borehole pressure. The inflatable sealing element 104A may be particularly suitable for, but not limited to, deployment in uncased, unlined wellbores. In addition, as shown in FIG. 2C, multiple inflatable sealing elements 104A may, optionally, be deployed in series for the sealing element section 104 (FIG. 1) of the downhole sealing apparatus 100 (FIG. 1) to ensure seal integrity.

Figure 3A:
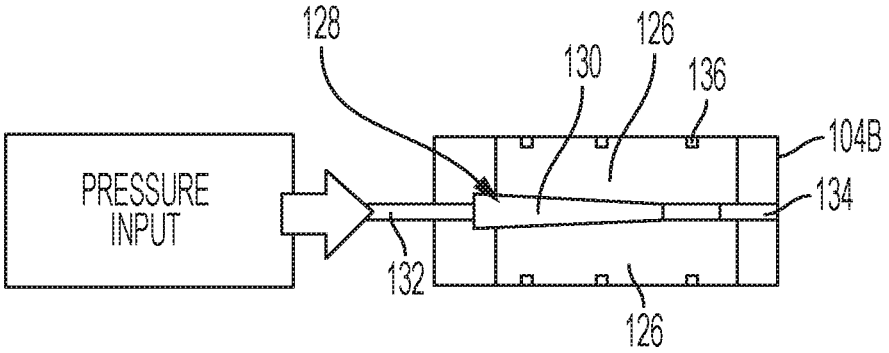
FIGS. 3A and 3B are simplified schematic views of a sealing element section of the downhole sealing apparatus shown in FIG. 1, in accordance with additional embodiments of the disclosure.
Figure 3B:
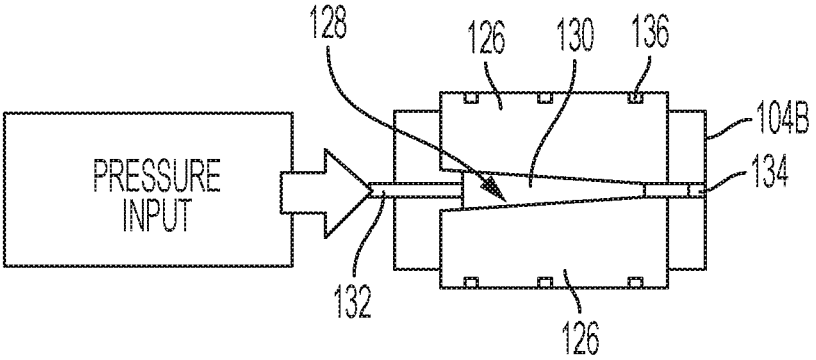

In additional embodiments, the sealing element section 104 (FIG. 1) of the downhole sealing apparatus 100 (FIG. 1) has an expandable design. For example, FIG. 3A shows a schematic illustration of an expandable sealing element 104B that may be employed for the sealing element section 104 of the downhole sealing apparatus 100 shown in FIG. 1. As shown in FIG. 3A, the expandable sealing element 104B may include one or more longitudinally adjacent seal structures 126 comprising a compressible material carried on a mandrel 128 comprising frustoconical wedge element 130 drivable by piston element 132 moveable through increased pressure facilitated by the production gases through the combustion of the propellant structure 108 (FIG. 1) of the propellant section 102 (FIG. 1) of the downhole sealing apparatus 100 (FIG. 1). The seal structures 126, may comprise, for example and without limitation, an elastomer or other compressible material known to those of ordinary skill in the art configured annularly or of frustoconical shape and suitable for maintaining structural integrity upon exposure to anticipated borehole conditions (e.g., temperatures, pressures, material types and exposures, etc.). Pressurized gas may move the mandrel 128 longitudinally, expanding the seal structures 126 radially, as depicted in FIG. 3B, to effect a seal against a casing, a liner, or a borehole (e.g., wellbore) wall. The expandable sealing element 104B may be suitable for, but not limited to, deployment in a cased or lined wellbore. Retraction of the mandrel 128 and thus of wedge element 130 may be effectuated by a spring 134, which may comprise, for example, a coil or Belleville spring compressed longitudinally by mandrel movement during packer expansion and which, upon normalization of borehole pressure will return the mandrel 128 to its initial longitudinal position. Additionally, circumferential spring elements 136 may be disposed about the seal structures 126 to ensure radial retraction of seal structures 126.

Figure 4A:
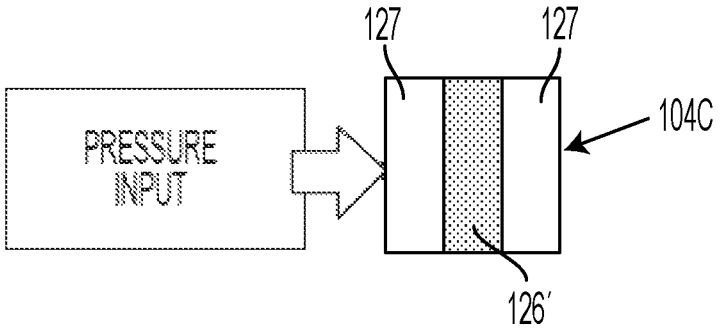
FIGS. 4A and 4B simplified schematic views of a sealing element section of the downhole sealing apparatus shown in FIG. 1, in accordance with further embodiments of the disclosure.
Figure 4B:
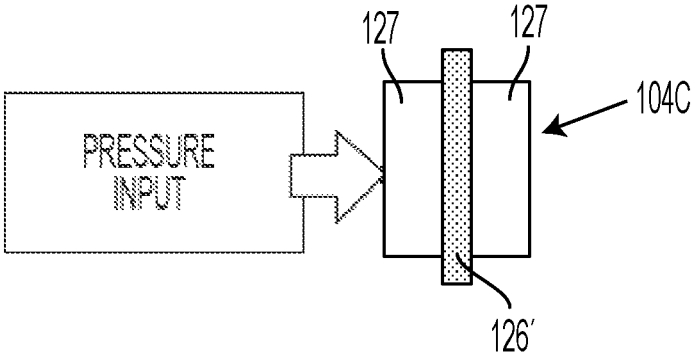

In further embodiments, the sealing element section 104 (FIG. 1) of the downhole sealing apparatus 100 (FIG. 1) exhibits a different an expandable design than that depicted in FIGS. 3A and 3B. By way of non-limiting example, FIG. 4A shows a schematic illustration of an expandable sealing element 104C that may be employed for the sealing element section 104 of the downhole sealing apparatus 100 shown in FIG. 1. As shown in FIG. 4A, the expandable sealing element 104C may include a seal structure 126' comprising a compressible material intervening between two (2) solid structures 127 (e.g., plate structures). The seal structure 126' may comprise, for example and without limitation, an elastomer or other compressible material known to those of ordinary skill in the art configured for maintaining structural integrity upon exposure to anticipated borehole conditions (e.g., temperatures, pressures, material types and exposures, etc.). Pressurized gas may move at least one of the solid structures 127 toward the other of the solid structures 127, compressing and radially expanding the seal structures 126', as depicted in FIG. 4B, to effect a seal against a casing, a liner, or a borehole (e.g., wellbore) wall. The expandable sealing element 104C may be suitable for, but not limited to, deployment in a cased or lined wellbore.

Figure 2C:
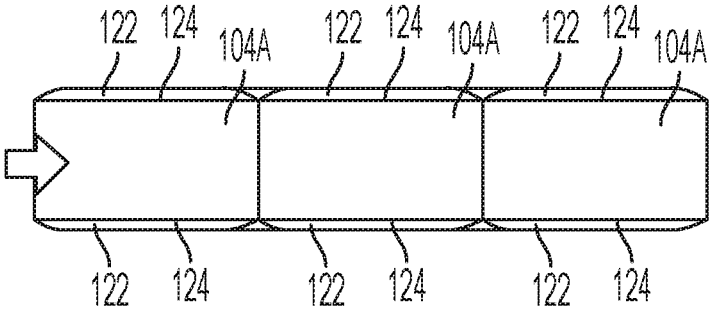

Multiple expandable sealing elements (e.g., multiple of the expandable sealing element 104B shown in FIGS. 3A and 3B; and/or multiple of the expandable sealing element 104C shown in FIGS. 4A and 4B) may, optionally, be employed in series (e.g., in a manner similar to that previously described with respect to the inflatable sealing elements 104A shown in FIG. 2C) for the sealing element section 104 (FIG. 1) of the downhole sealing apparatus 100 (FIG. 1) to ensure seal integrity. In addition, a combination of one or more inflatable sealing elements 104A (FIG. 2A) and one or more expandable sealing elements (e.g., one or more expandable sealing elements 104B; and/or one or more of the expandable sealing elements 104C) may, optionally, be employed in series (e.g., in a manner similar to that previously described with respect to the inflatable sealing elements 104A shown in FIG. 2C) for the sealing element section 104 (FIG. 1) of the downhole sealing apparatus 100 (FIG. 1) to ensure seal integrity.

With returned reference to FIG. 1, unlike many conventional downhole sealing apparatuses and techniques, the downhole sealing apparatus 100 of the disclosure facilitates the simple, efficient, and temporary sealing of a borehole (e.g., a wellbore) in a subterranean formation. The duration of the sealing effectuated by the downhole sealing apparatus 100 may be tailored to specific downhole application needs by selectively configuring the propellant structure 108 thereof according to those needs. For example, the type(s) and volume(s) of propellant used in the propellant structure 108 may be selected to achieve activation of the sealing element section 104 of the downhole sealing apparatus 100 (and, hence, sealing of a portion of the borehole) for a predetermined amount of time, after which the sealing element section 104 may deactivate (e.g., deflate, retract) to permit the simple and efficient removal of the downhole sealing apparatus 100 from the borehole. The configuration of the downhole sealing apparatus 100 of the disclosure may reduce difficulties, inefficiencies, and losses (e.g., material losses, time losses, equipment losses, etc.) associated with sealing a borehole through conventional means, such as difficulties, inefficiencies, and losses otherwise associated with setting and/or removing (if even possible) a conventional downhole sealing apparatus before and/or after effectuating (e.g., implementing) a desired downhole operation (e.g., a logging operation, a measurement operation, a coring operation, a conditioning operation, a monitoring operation, a completion operation, etc.).

Figure 5:
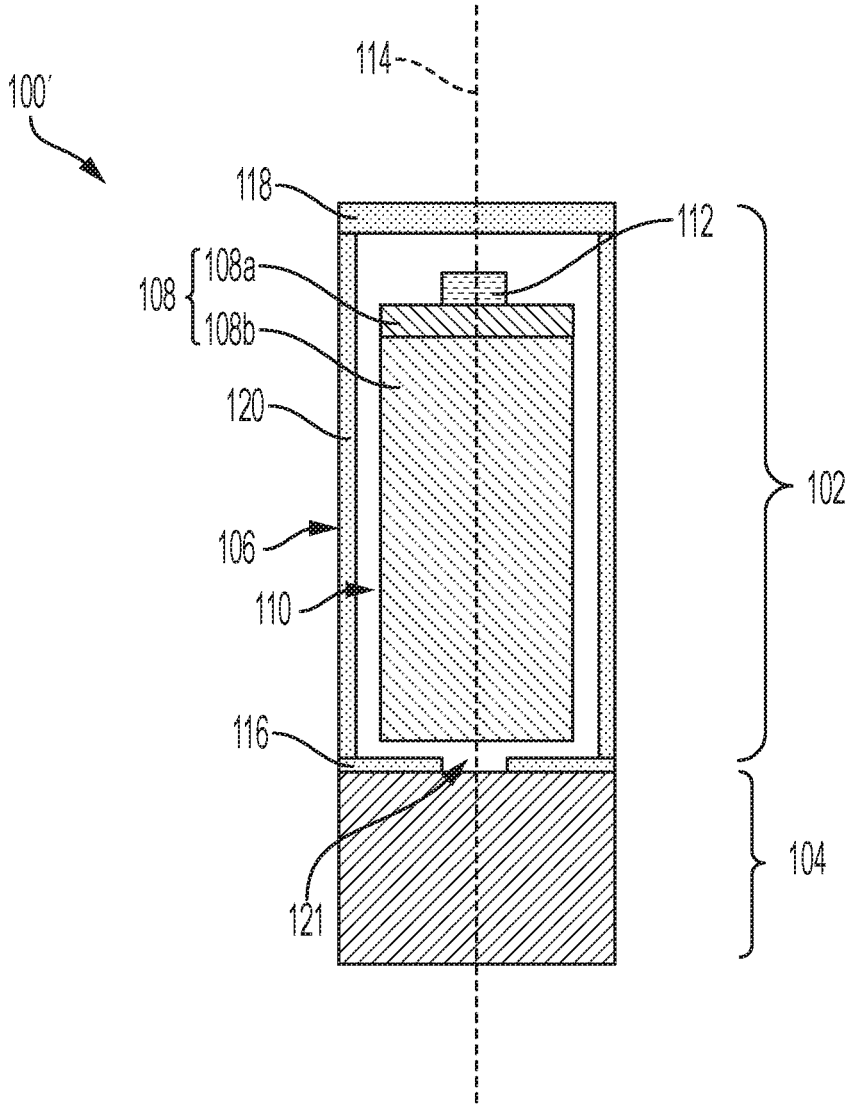
FIGS. 5 and 6 are simplified longitudinal, cross-sectional views of different downhole sealing apparatuses, in accordance with additional embodiments of the disclosure.

While FIG. 1 illustrates a specific configuration of the downhole sealing apparatus 100, one of ordinary skill in the art will appreciate that various modifications may be made to one or more components of the downhole sealing apparatus 100 while still facilitating the desirable functionalities thereof. By way of non-limiting example, FIG. 5 is a simplified longitudinal cross-sectional view of a downhole sealing apparatus 100', in accordance with additional embodiments of the disclosure. The downhole sealing apparatus 100' may be substantially similar to the downhole sealing apparatus 100 previously described with reference to FIG. 1, except that the orientation of the propellant structure 108 within the outer housing 106 of the propellant section 102 may be rotated 180 degrees, which may also effectuate a change to the position of the initiator device 112 within the outer housing 106. As a result, upon activation (e.g., firing) of the initiator device 112, gases produced by combustion of the propellant structure 108 may bypass remaining (e.g., non-combusted) portions of the propellant structure 108 to activate (e.g., inflate, expand) the sealing element section 104 of the downhole sealing apparatus 100'. The gases may, for example, bypass the remaining portions of the propellant structure 108 through channels 110 intervening between inner surfaces of the outer housing 106 and outer surfaces of the remaining portions of the propellant structure 108. By way of non-limiting example, the channels 110 may comprise recesses in the inner surfaces of the outer housing 106 and/or the outer surfaces of the remaining portions of the propellant structure 108, or may comprise hollow structures (e.g., tubular structures) disposed between the outer housing 106 and the propellant structure 108. As another approach to provide one or more gas bypass paths, the propellant structure 108 may be suspended within the outer housing by so-called "spiders" disposed circumferentially about the propellant structure 108 at longitudinal intervals and having apertures extending longitudinally therethrough, so as to form a generally annular void space between outer housing 106 and the propellant structure 108.

Figure 6:
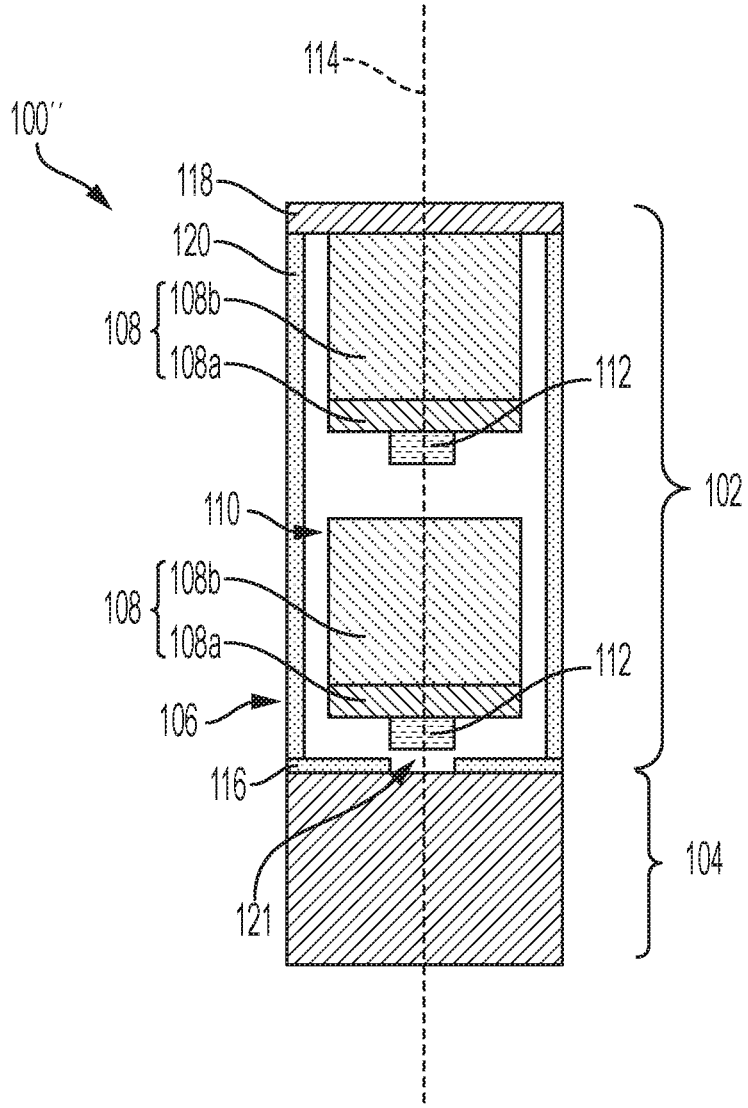

FIG. 6 is a simplified longitudinal cross-sectional view of a downhole sealing apparatus 100", in accordance with additional embodiments of the disclosure. The downhole sealing apparatus 100" may be similar to the downhole sealing apparatus 100 previously described with reference to FIG. 1, except that the propellant section 102 thereof may include multiple (e.g., more than one) propellant structures 108, and multiple initiator devices 112 associated with the multiple propellant structures 108. The multiple propellant structures 108 may be discrete (e.g., separate, spaced apart, detached) from one another, and may each individually be operatively associated with one or more of the multiple initiator devices 112. For example, as shown in FIG. 6, the outer housing 106 of the propellant section 102 may contain at least two (2) propellant structures 108 discrete from one another, and each of the at least two (2) propellant structures 108 may include at least one (1) initiator device 112 operatively associated therewith (e.g., adjacent thereto). Each of the multiple propellant structures 108 may exhibit substantially the same configuration (e.g., substantially the same dimensions, propellants, propellant regions, propellant region combustion rates, propellant region sequences, propellant region volumes, etc.) as one another, or at least one of the multiple propellant structures 108 may exhibit a different configuration than at least one other of the multiple propellant structures 108. During use and operation of the downhole sealing apparatus 100", the propellant structures 108 may be initiated (e.g., by way of the initiator devices 112) and combusted simultaneously, sequentially, or a combination thereof.

With continued reference to FIG. 6, including multiple propellant structures 108 within the propellant section 102 of the downhole sealing apparatus 100" may permit at least one of the propellant structures 108 to be initiated and combusted without initiating and combusting at least one other of the propellant structures 108, which may permit the downhole sealing apparatus 100" to be used for multiple sealing acts without having to reload the propellant section 102 with additional propellant (e.g., one or more additional propellant structures). For example, a first of the propellant structures 108 may be initiated (e.g., by firing a first of the multiple initiator devices 112) and combusted to activate (e.g., set, inflate, expand) the sealing element section 104 of the downhole sealing apparatus 100" for a first sealing act, the sealing element section 104 may deactivate (e.g., deflate, retract) following the substantially complete combustion of the first of the propellant structures 108, and then a second of the propellant structures 108 may be initiated (e.g., by firing a second of the multiple initiator devices 112) and combusted to re-activate (e.g., set, inflate, expand) the sealing element section 104 of the downhole sealing apparatus 100" for a second sealing act. Any desired period of time may intervene between the initiation of the first of the propellant structures 108 and the initiation of the second of the propellant structures 108. In addition, the downhole sealing apparatus 100" may be retained at substantially the same position (e.g., at a desired position within a borehole in a subterranean formation) for the first sealing act and the second sealing act, or may be moved (e.g., to a different desired position within the borehole in the subterranean formation, to a desired portion within another borehole in the subterranean formation) for the second sealing act following the termination of the first sealing act (e.g., following the deactivation of the sealing element section 104 at the end of the first sealing act).

Figure 7:
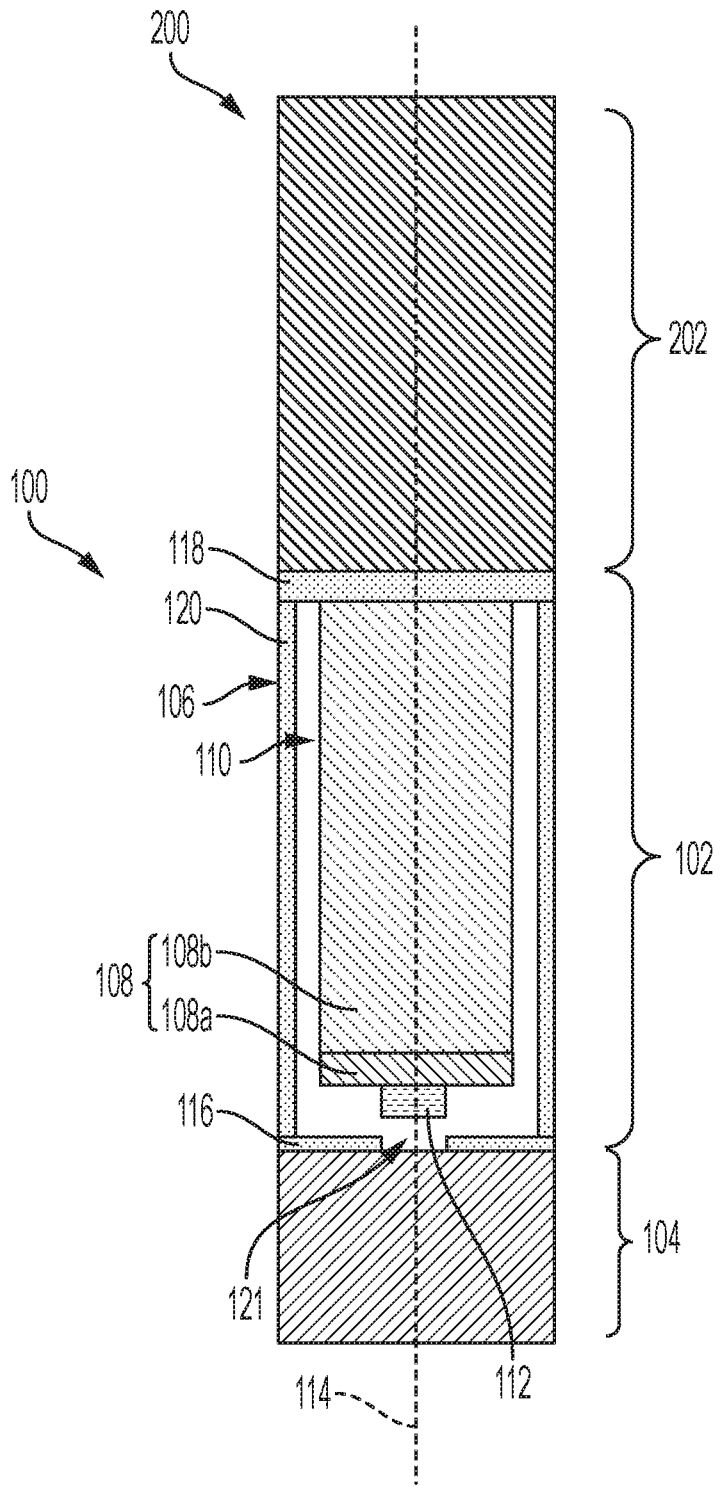
FIGS. 7 through 9 are simplified longitudinal, cross-sectional views of different downhole assemblies, in accordance with embodiments of the disclosure.

Downhole sealing apparatuses (e.g., the downhole sealing apparatuses 100, 100', 100") according to embodiments of the disclosure may be employed in embodiments of downhole assemblies of the disclosure. For example, FIG. 7 is a simplified longitudinal schematic view of a downhole assembly 200 according to embodiments of disclosure. As shown in FIG. 7, the downhole assembly 200 may include the downhole sealing apparatus 100 previously described with reference to FIG. 1 attached to at least one downhole device 202. The downhole device 202 may, for example, be attached to the downhole sealing apparatus 100 at or proximate the second end 118 of the outer housing 106 of the propellant section 102 of the downhole sealing apparatus 100. In additional embodiments, the downhole device 202 is attached to the downhole sealing apparatus 100 at one or more different locations (e.g., one or more locations relatively more distal from the second end 118 of the outer housing 106 of the propellant section 102, such as one or more locations along the sidewall 120 of the outer housing 106). As shown in FIG. 7, in some embodiments, the second end 118 of the outer housing 106 of the propellant section 102 is positioned at or proximate a lowermost longitudinal (e.g., vertical) boundary of the downhole device 202. In additional embodiments, the second end 118 of the outer housing 106 of the propellant section 102 is located more distal from the lowermost longitudinal boundary of the downhole device 202. By way of non-limiting example, at least a portion (e.g., substantially all) of the propellant section 102 of the downhole sealing apparatus 100 may disposed within a cavity within downhole device 202, such that the second end 118 of the outer housing 106 of the propellant section 102 is longitudinally offset from (e.g., longitudinally overlies) the lowermost longitudinal boundary of the downhole device 202. In such embodiments the lowermost longitudinal boundary of the downhole device 202 downhole device 202 may be positioned relativity more proximate (e.g., longitudinally adjacent) the sealing element section 104 of the downhole sealing apparatus 100. The downhole device 202 may be removably attached to the downhole sealing apparatus 100, or may be substantially permanently attached (e.g., absent permanent destructive action to one or more attachment means) to the downhole sealing apparatus 100. In some embodiments, the downhole device 202 is removably attached to the downhole sealing apparatus 100 (e.g., to the outer housing 106 of the propellant section 102 of the downhole sealing apparatus 100). For example, the downhole device 202 may be removably attached to the downhole sealing apparatus 100 by way of one or more of complementary thread structures (e.g., threading projections) and complementary pin and opening features exhibited by the downhole device 202 and the downhole sealing apparatus 100. In additional embodiments, the downhole device 202 is substantially permanently attached to the downhole sealing apparatus 100 (e.g., to the outer housing 106 of the propellant section 102 of the downhole sealing apparatus 100). For example, the downhole device 202 may be welded, brazed, soldered, and/or substantially permanently adhesively bonded to the downhole sealing apparatus 100.

The downhole device 202 of the downhole assembly 200 may comprise any device (e.g., tool) or combination of devices (e.g., tool string) that may be employed for a desired downhole application (e.g., a logging application, a measurement application, a coring application, a conditioning application, a monitoring application, a completion application, etc.). By way of non-limiting example, the downhole device 202 may comprise at least one downhole tools, such as one or more of a logging tool (e.g., a formation testing tool, such as a tool configured and operated to measure one or more of the temperature, pressure, radioactivity, porosity, density, and material composition of a subterranean formation), a measurement tool (e.g., a downhole fluid analysis tool, such as a tool configured and operated to analyze one or more of the temperature, pressure, viscosity, and material composition of one or more downhole fluids), a coring tool, a conditioning tool (e.g., a casing conditioning tool, a liner conditioning tool), a monitoring tool, and a completion tool (e.g., a stabilizer tool).

The configuration of the downhole assembly 200, including the configuration of the downhole sealing apparatus 100 attached to the downhole device 202, advantageously enhances the simplicity and efficiency of downhole operations associated therewith relative to conventional means of effectuating the downhole operations. For example, the configuration of the downhole assembly 200, permits the downhole sealing apparatus 100 and the downhole device 202 to be provided into a borehole in a subterranean formation at substantially the same time (e.g., as a single unit), permits the downhole sealing apparatus 100 to be activated (e.g., set) just before desired use of the downhole device 202, and also permits the downhole sealing apparatus 100 to be quickly and easily removed from the borehole following the desired use of the downhole device 202. In contrast, conventional means of preparing (e.g., sealing) a borehole for a desired downhole operation employing a conventional downhole sealing apparatus discrete (e.g., separated, detached) from a conventional downhole device may require additional acts and resources (e.g., equipment) to separately deliver the downhole sealing apparatus and the downhole device into a borehole in a subterranean formation, may require activating the downhole sealing apparatus well in advance of desired use of the downhole device (e.g., before the downhole device is even delivered into the borehole), and/or may require additional acts and resources to separately remove (if at all) the downhole sealing apparatus following the desired use of the downhole device.

In additional embodiments, the downhole assembly 200 may exhibit a different configuration that that depicted in FIG. 7. For example, while in the embodiment depicted in FIG. 6 the downhole sealing apparatus 100 is positioned longitudinally below the downhole device 202, in additional embodiments the downhole sealing apparatus 100 may be positioned longitudinally above the downhole device 202. As another example, while the downhole device 202 is attached to the propellant section 102 (e.g., to the outer housing 106 of the propellant section 102) of the downhole sealing apparatus 100 in the embodiment depicted in FIG. 7, in additional embodiments the downhole device 202 may be attached (e.g., removably attached, substantially permanently attached) to the sealing element section 104 of the downhole sealing apparatus 100.

Figure 8:
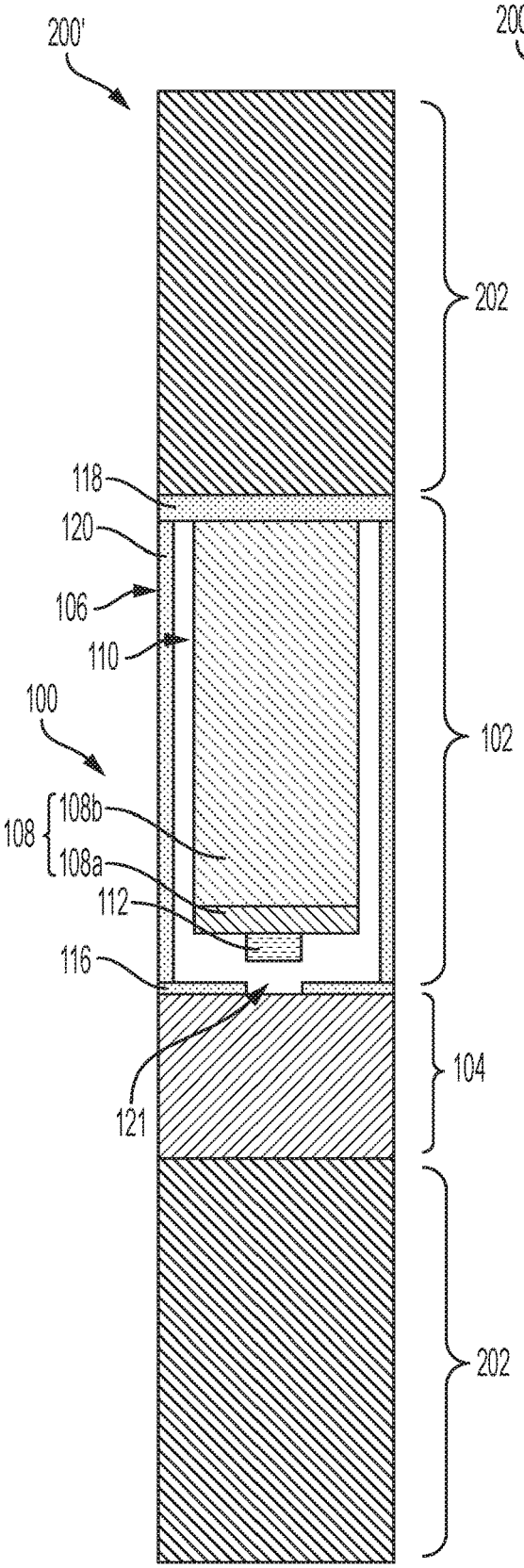

FIG. 8 is a simplified longitudinal cross-sectional view of a downhole assembly 200', in accordance with additional embodiments of the disclosure. The downhole assembly 200' may be similar to the downhole assembly 200 previously described with reference to FIG. 6, except that the downhole sealing apparatus 100 thereof may be attached (e.g., removably attached, substantially permanently attached) to and positioned between and two (2) downhole devices 202 or two (2) portions of a single (e.g., only one) downhole device 202. For example, as shown in FIG. 8, a first downhole device 202 (or a first portion of a single downhole device 202) may be attached to a first end of the downhole sealing apparatus 100 (e.g., an end of the sealing element section 104 of the downhole sealing apparatus 100), and a second downhole device 202 (or a second portion of the single downhole device 202) may be attached to a second, opposing end of the downhole sealing apparatus 100 (e.g., an end of the propellant section 102 of the downhole sealing apparatus 100). The two (2) downhole devices 202 (or the two (2) portions of a single downhole device 202) may have substantially the same configuration as one another, or may have different configurations than one another.

Figure 9:
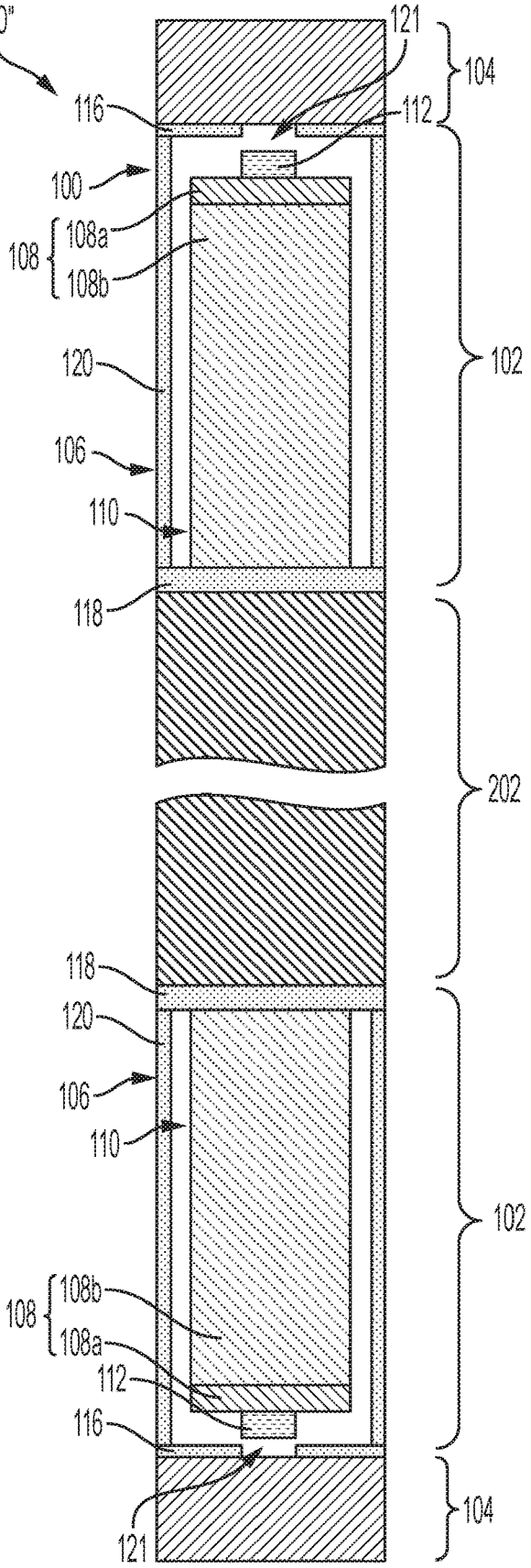

FIG. 9 is a simplified longitudinal cross-sectional view of a downhole assembly 200", in accordance with further embodiments of the disclosure. The downhole assembly 200" may be similar to the downhole assembly 200 previously described with reference to FIG. 7, except that two (2) downhole sealing apparatuses 100 may be attached (e.g., removably attached, substantially permanently attached) to the downhole device 202. For example, as shown in FIG. 9, a first downhole sealing apparatus 100 may be attached to a first end of the downhole device 202, and a second downhole sealing apparatus 100 may be attached to a second, opposing end of the downhole device 202. The two (2) downhole sealing apparatuses 100 may have substantially the same configuration as one another, or may have different configurations than one another. In some embodiments, the two (2) downhole sealing apparatuses 100 exhibit substantially the same configuration as one another, but substantially longitudinally mirror one another. In additional embodiments, the two (2) downhole sealing apparatuses 100 exhibit mutually different configurations than one another. The two (2) downhole sealing apparatuses 100 of the downhole assembly 200" may, for example, be employed to seal different locations (e.g., different intervals) within a borehole (e.g., wellbore) in a subterranean formation at the same time (e.g., simultaneously) or at different times (e.g., sequentially). By way of non-limiting example, the downhole assembly 200" may be deployed to a first location (e.g., a first interval) within a borehole and a first of the downhole sealing apparatuses 100 and may be activated to provide desired sealing, then, after desired downhole operations have been completed at the first location and the sealing provided by the first of the downhole sealing apparatuses 100 has been terminated, the downhole assembly 200" may be moved to a second location (e.g., a second interval) within the borehole and a second of the downhole sealing apparatuses 100 and may be activated to provide additional sealing for additional downhole operations.

Figure 10:
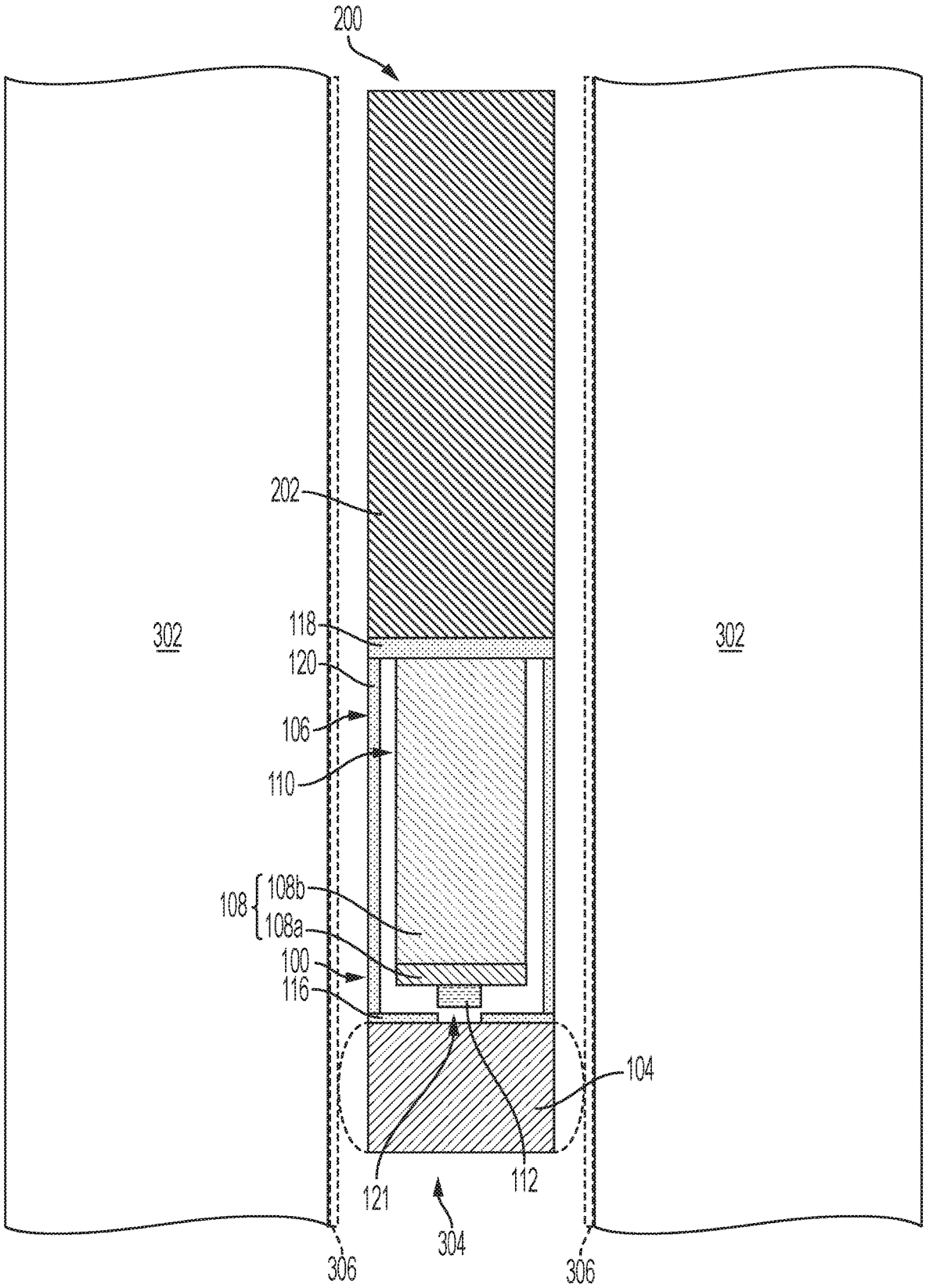
FIG. 10 is a simplified longitudinal schematic view illustrating a method of acting upon a subterranean formation using a downhole assembly of the disclosure, in accordance with embodiments of the disclosure.

Downhole assemblies (e.g., the downhole assemblies 200, 200', 200") according to embodiments of the disclosure may be employed in methods of the disclosure to act upon (e.g., treat, analyze, monitor, etc.) a subterranean formation. For example, FIG. 10 is a longitudinal schematic view illustrating the use of the downhole assembly 200 previously described with reference to FIG. 7 to act upon portions of a subterranean formation 302 (e.g., a producing formation) adjacent a borehole 304 (e.g., a wellbore). The downhole assembly 200 may be deployed to a pre-determined location within the borehole 304 by conventional processes and equipment (e.g., wireline, tubing, coiled tubing, etc.), and may, optionally, be secured (e.g., anchored) into position. As shown in FIG. 10, the downhole assembly 200 may, optionally, be deployed within a casing 306 lining the borehole 304. After the downhole assembly 200 is deployed, one or more initiator devices 112 of the downhole sealing apparatus 100 may be activated, such as by electricity and/or pressure, to initiate the combustion (e.g., simultaneous combustion, sequential combustion, or combinations thereof) of one or more regions of at least one propellant structure 108 of the downhole sealing apparatus 100. The combustion of the propellant structure 108 generates gases in accordance with the configurations (e.g., dimensions, propellants, propellant regions, propellant region combustion rates, propellant region sequences, propellant region volumes, etc.) of the propellant structure 108. The gases facilitate activation (e.g., setting, inflation, expansion) of the sealing element section 104 of the downhole sealing apparatus 100 to seal off the borehole 304 at the sealing element section 104 of the downhole sealing apparatus 100 for a predetermined amount of time, during which the downhole device 202 may act upon the subterranean formation 302. Thereafter, the downhole sealing apparatus 100 may deactivate (e.g., deflate, retract) to unseal the borehole 304 at the sealing element section 104 of the downhole sealing apparatus 100 and facilitate removal of the downhole assembly 200 from the borehole 304.

While the disclosure is susceptible to various modifications and alternative forms, specific embodiments have been shown by way of example in the drawings and have been described in detail herein. However, the disclosure is not limited to the particular forms disclosed. Rather, the disclosure is to cover all modifications, equivalents, and alternatives falling within the scope of the disclosure as defined by the following appended claims and their legal equivalents. For example, elements and features disclosed in relation to one embodiment of the disclosure may be combined with elements and features disclosed in relation to other embodiments of the disclosure.

What is claimed is:

1. A downhole sealing apparatus, comprising:

a propellant section comprising:

an outer housing comprising:

a first end having an aperture extending therethrough, the aperture exhibiting a smaller diameter than a longitudinally central portion of the outer housing;

a second end opposing the first end, the second end substantially free of apertures extending therethrough; and a tubular sidewall extending from and between the first end and the second end, the tubular sidewall substantially free of apertures extending therethrough;

at least one propellant structure within the outer housing; and at least one initiator device adjacent the at least one propellant structure; and a sealing element section adjacent the first end of the outer housing of the propellant section and in communication with the aperture, the sealing element section comprising one or more expandable apparatuses configured to isolate a region of a borehole in a subterranean formation responsive to pressure of gases produced through combustion of at least one propellant of the at least one propellant structure of the propellant section, and received through the aperture.

2. The downhole sealing apparatus of claim 1, wherein the at least one propellant structure of the propellant section comprises:

at least one faster combustion rate propellant region; and at least one slower combustion rate propellant region longitudinally adjacent the at least one faster combustion rate propellant region.

3. The downhole sealing apparatus of claim 2, wherein the at least one of the faster combustion rate propellant region exhibits a different volume of propellant than the at least one slower combustion rate propellant region.

4. The downhole sealing apparatus of claim 1, wherein the at least one propellant structure is a substantially homogeneous structure comprising only one propellant.

5. The downhole sealing apparatus of claim 1, wherein the at least one propellant structure comprises multiple propellant structures, each of the multiple propellant structures spaced apart from each other of the multiple propellant structures.

6. The downhole sealing apparatus of claim 5, wherein the at least one initiator device comprises multiple initiator devices, each of the multiple propellant structures having at least one of the multiple initiator devices positioned adjacent thereto.

7. The downhole sealing apparatus of claim 1, wherein the sealing element section is attached to the outer housing of the propellant section.

8. The downhole sealing apparatus of claim 1, wherein the sealing element section comprises at least one inflatable sealing element.

9. The downhole sealing apparatus of claim 1, wherein the sealing element section comprises at least one expandable sealing element.

10. The downhole sealing apparatus of claim 1, wherein a diameter of the aperture extending through the first end of the outer housing of the propellant section is smaller than an internal diameter of the tubular sidewall of the outer housing.

11. A downhole assembly, comprising:

at least one downhole device; and at least one downhole sealing apparatus attached to the at least one downhole device and comprising:

a propellant section comprising:

an outer housing comprising:

a first end having an aperture extending therethrough, the aperture exhibiting a smaller diameter than a longitudinally central portion of the outer housing;

a second end opposing the first end, the second end substantially free of apertures extending therethrough; and a tubular sidewall extending from and between the first end and the second end, the tubular sidewall substantially free of apertures extending therethrough;

a propellant structure within the outer housing; and an initiator device within the outer housing and adjacent the propellant structure; and a sealing element section adjacent the first end of the outer housing of the propellant section and in communication with the aperture, the sealing element section comprising one or more expandable apparatuses configured to isolate a region of a borehole in a subterranean formation responsive to pressure of gases produced through combustion of at least one propellant of the propellant structure of the propellant section, and received through the aperture.

12. The downhole assembly of claim 11, wherein the at least one downhole device comprises one or more of a logging tool, a measurement tool, a coring tool, a conditioning tool, a monitoring tool, and a completion tool.

13. The downhole assembly of claim 11, wherein the at least one downhole device is removably attached to the at least one downhole sealing apparatus.

14. The downhole assembly of claim 11, wherein the at least one downhole device comprises at least two downhole devices attached to the at least one downhole sealing apparatus.

15. The downhole assembly of claim 14, wherein a configuration of at least one of the at least two downhole devices is different than that of at least one other of the at least two downhole devices.

16. The downhole assembly of claim 11, wherein the at least one downhole sealing apparatus is disposed between and attached to two different portions of a single downhole device.

17. The downhole assembly of claim 11, wherein the at least one downhole sealing apparatus comprises at least two downhole sealing apparatuses attached to the at least one downhole device.

18. The downhole assembly of claim 17, wherein a configuration of at least one of the at least two downhole sealing apparatuses is different than that of at least one other of the at least two downhole sealing apparatuses.

19. A method of isolating portions of a borehole in a subterranean formation, comprising:

positioning a downhole assembly within a borehole extending into the subterranean formation, the downhole assembly comprising:

a downhole device; and a downhole sealing apparatus attached to the downhole device and comprising:

a propellant section comprising:

an outer housing comprising:

a first end having an aperture extending therethrough, the aperture exhibiting a smaller diameter than a longitudinally central portion of the outer housing;

a second end opposing the first end, the second end substantially free of apertures extending therethrough; and a tubular sidewall extending from and between the first end and the second end, the tubular sidewall substantially free of apertures extending therethrough;

a propellant structure within the outer housing; and an initiator device adjacent the propellant structure; and a sealing element section comprising one or more expandable apparatuses adjacent to the first end of the outer housing of the propellant section and in communication with the aperture; and activating the initiator device of the propellant section of the downhole sealing apparatus to initiate and combust at least one propellant of the propellant structure and produce gases that are directed to activate the sealing element section of the downhole sealing apparatus and seal across the borehole, the produced gases being received by the sealing element section through the aperture.

20. The method of claim 19, further comprising removing remaining portions of the downhole device and the downhole sealing apparatus of the downhole assembly from the borehole as a single unit following substantially complete combustion of the at least one propellant of the propellant structure of the downhole sealing apparatus.

* * * * *